US007770494B2

(12) United States Patent
Cornwell et al.

(10) Patent No.: US 7,770,494 B2
(45) Date of Patent: Aug. 10, 2010

(54) RATCHET DRIVER

(75) Inventors: W. Robert Cornwell, Ronan, MT (US); Nathan C. Cantlon, Charlo, MT (US); Jesse Croft, Ronan, MT (US)

(73) Assignee: Jore Corporation, Ronan, MT (US)

( * ) Notice: Subject to any disclaimer, the term of this patent is extended or adjusted under 35 U.S.C. 154(b) by 0 days.

(21) Appl. No.: 11/744,372

(22) Filed: May 4, 2007

(65) Prior Publication Data

US 2007/0256524 A1 Nov. 8, 2007

Related U.S. Application Data

(60) Provisional application No. 60/797,438, filed on May 4, 2006.

(51) Int. Cl.
*B25B 17/00* (2006.01)
*B25B 13/46* (2006.01)

(52) U.S. Cl. ..... 81/57.3; 81/58.1

(58) Field of Classification Search ..... 81/57.3, 81/57.29, 57.31, 57.39, 58.1
See application file for complete search history.

(56) References Cited

U.S. PATENT DOCUMENTS

| | | | | |
|---|---|---|---|---|
| 2,520,443 | A * | 8/1950 | Seaquist | 475/3 |
| 3,587,364 | A * | 6/1971 | Peyre | 81/57.39 |
| 3,945,274 | A * | 3/1976 | Annett, II | 81/58.1 |
| 4,475,420 | A * | 10/1984 | Atkinson et al. | 81/58.3 |
| 5,009,132 | A * | 4/1991 | Gilberto | 81/57.3 |
| 6,681,660 | B2 * | 1/2004 | Foard | 81/57.31 |
| 2003/0213341 | A1 * | 11/2003 | Alden | 81/57.29 |

* cited by examiner

*Primary Examiner*—D. S Meislin
(74) *Attorney, Agent, or Firm*—Christensen O'Connor Johnson Kindness PLLC

(57) ABSTRACT

A ratchet device constructed in accordance with one embodiment of the present disclosure is depicted. The ratchet device includes a ratchet body having a handle and a ratchet head. The handle is reciprocably rotatable in first and second handle directions about an axis extending substantially normal to a major axis of the ratchet head. The ratchet device further includes an output member coupled to the ratchet head, wherein the output member is rotatable in a substantially constant output member direction when the handle is reciprocated between first and second handle directions.

5 Claims, 5 Drawing Sheets

RATCHET DRIVER

CROSS-REFERENCE TO RELATED APPLICATION

This application claims the benefit of U.S. Provisional Application No. 60/797,438, filed May 4, 2006, the disclosure of which is hereby expressly incorporated by reference.

BACKGROUND

Ratchet devices are commonly used to drive a fastener, such as a bolt or nut, especially where the fastener is located in a restricted area. When the fastener is not accessible from all sides, a wrench or other similar tool cannot likely engage the fastener and rotate 360° with respect to the fastener to drive the fastener. Thus, the wrench must be removed each time it engages an obstruction so that it may be resituated on the fastener to continue driving the fastener in the appropriate direction.

A ratchet is designed to drive a fastener in a restricted area without removing the ratchet from the fastener. A ratchet includes a socket that engages and transmits torque to the fastener. The torque is transmitted to the socket member by moving the ratchet in a rotary motion. With a standard ratchet, the fastener is tightened or loosened only on the drive stroke, and not on the return stroke. The ratchet typically includes a positioning system that allows the ratchet to tighten or loosen the fastener in the drive direction, and transmits no appreciable torque in the opposite return stroke direction. On the drive stroke, the ratchet transmits torque to the fastener, and on the return stroke, the positioning system enables the ratchet body to rotate about the socket. Accordingly, the ratchet need not be removed from the fastener to return the ratchet to its original position because no torque is transmitted to the socket or fastener on the return stroke.

SUMMARY

A ratchet device constructed in accordance with one embodiment of the present disclosure is depicted. The ratchet device includes a ratchet body having a handle and a ratchet head. The handle is reciprocably rotatable in first and second handle directions about an axis extending substantially normal to a major axis of the ratchet head. The ratchet device further includes an output member coupled to the ratchet head, wherein the output member is rotatable in a substantially constant output member direction when the handle is reciprocated between first and second handle directions.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this disclosure will become better understood by reference to the following detailed description, when taken in conjunction with the accompanying drawings, wherein.

DETAILED DESCRIPTION

FIGS. 1-5 depict the preferred embodiment of a ratchet device 10. For ease of illustration and clarity, the ratchet device 10 is shown in a substantially vertical orientation, although it may be suitably used in any orientation, such as horizontal. Therefore, the terminology "front," "rear", "upper," "lower", etc. should be construed as descriptive and not limiting.

Figure 1:
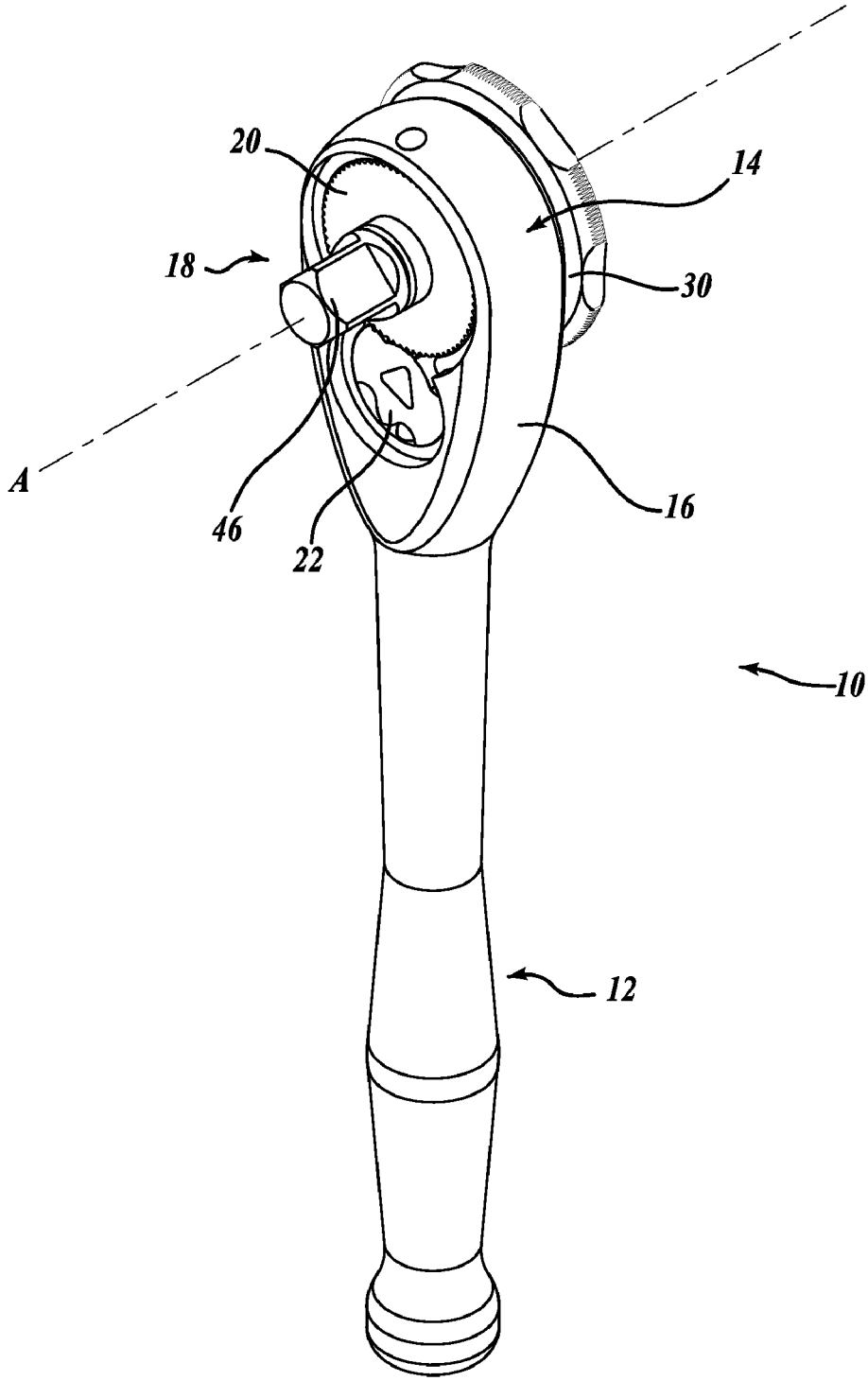
FIG. 1 is an isometric view of the ratchet device.

Referring to FIG. 1, the ratchet device 10 includes a ratchet body having a handle 12 and a ratchet head 16. The handle 12 may be any shape and size, but is preferably cylindrical in shape and of a size to enable a user to comfortably grip the handle 12 when using the ratcheting device 10. Coupled to upper portion of the handle 12 is a ratchet head 16 having a circular upper portion 14. Preferably, the handle 12 and the ratchet head 16 are formed as one piece, but it can be appreciated that the handle 12 and the ratchet head 16 may be formed separately and thereafter mated together.

Figure 2:
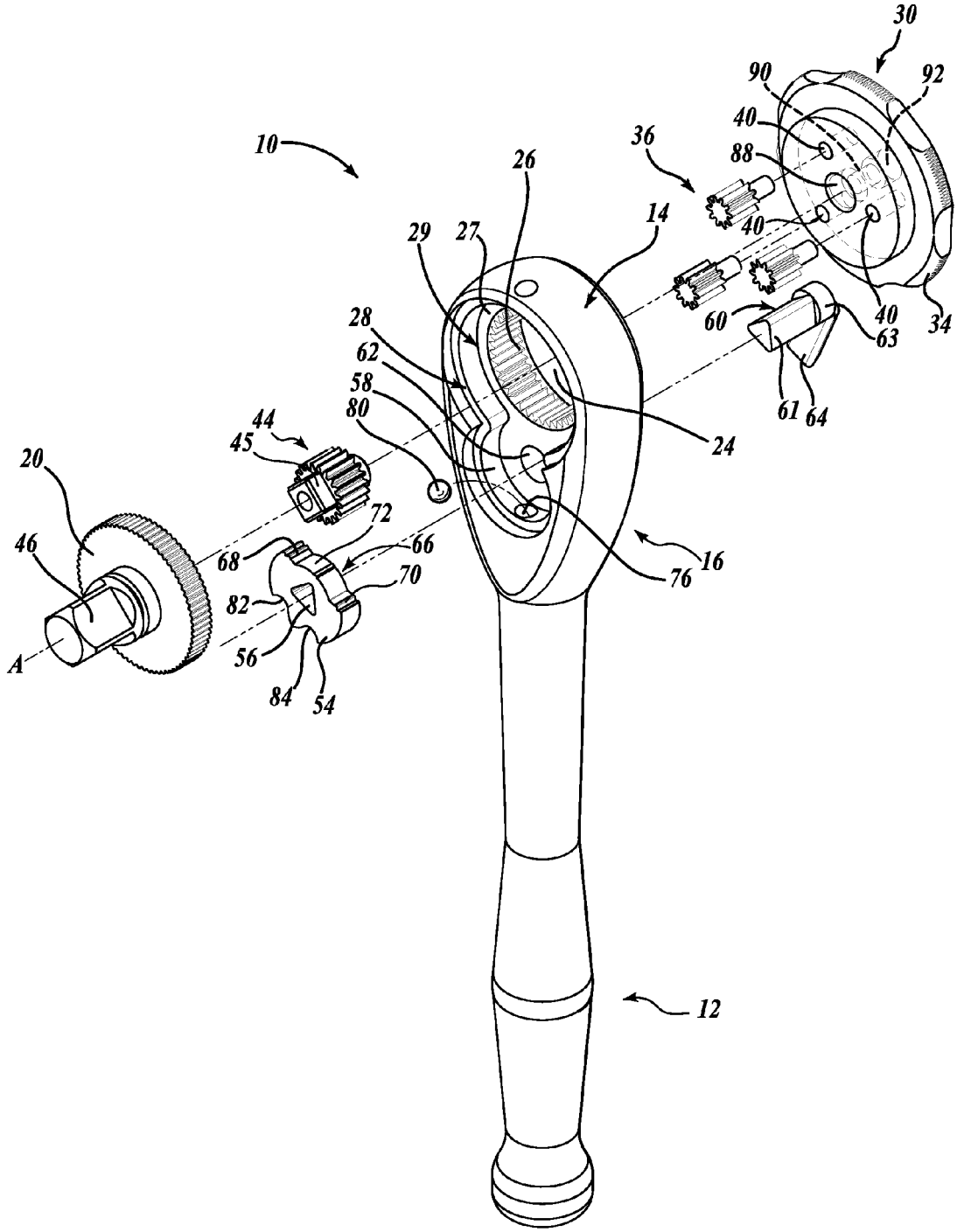
FIG. 2 is an exploded isometric view of the ratchet device of FIG. 1.

Now referring to FIG. 2, the ratchet head 16 includes first and second counterbores 28 and 29 formed within the circular upper portion 14. The second counterbore 29 defines a counterbore surface 27, and a circular receiving hole 24 is formed therewithin. A third counterbore (not shown) is formed on the rear side of the circular upper portion 14.

The ratchet device 10 includes a pommel 30 that is circular in shape and has substantially flat front and rear surfaces and a circular edge 34. A raised circular portion 32 is formed on the front surface of the pommel 30. The pommel 30 is mated with the ratchet head 16 such that the raised circular portion 32 is received within the third counterbore.

The pommel 30 is preferably slightly larger in diameter than the circular upper portion 14 of the ratchet head 16 such that a user can easily grip the pommel circular edge 34 when applying a torque to the handle 12 (as later described). The pommel 30 may include grooves, ridges, depressions, or other formations along the pommel circular edge 34 to act as a gripping member when using the ratchet device 10.

Still referring to FIG. 2, the ratchet device 10 includes a gear assembly 18 that is disposed within the upper circular portion 14 of the ratchet head 16. The gear assembly 18 includes a ring gear 26 having straight teeth and formed on the inside surface of the receiving hole 24. The gear assembly 18 further includes at least three planetary gears 36 having teeth that are rotatably mounted within cavities 40 formed in the raised circular portion 32 of the pommel 30. A retaining plate (not shown) may also be used to further secure the planetary gears 36 within the cavities 40. Preferably, the planetary gears 36 are spaced equidistant from one another on the raised circular portion 32. The planetary gears 36 are positioned such that they engage the ring gear 26 so that the ring gear 26 drives the planetary gears 36 when the ring gear 26 is rotated. The gear assembly 18 also includes a sun gear 44 having teeth and sized to be disposed in the middle of and engage all three planetary gears 36. The sun gear 44 is concentrically coupled to the inside surface of an output gear 20.

Figure 3:
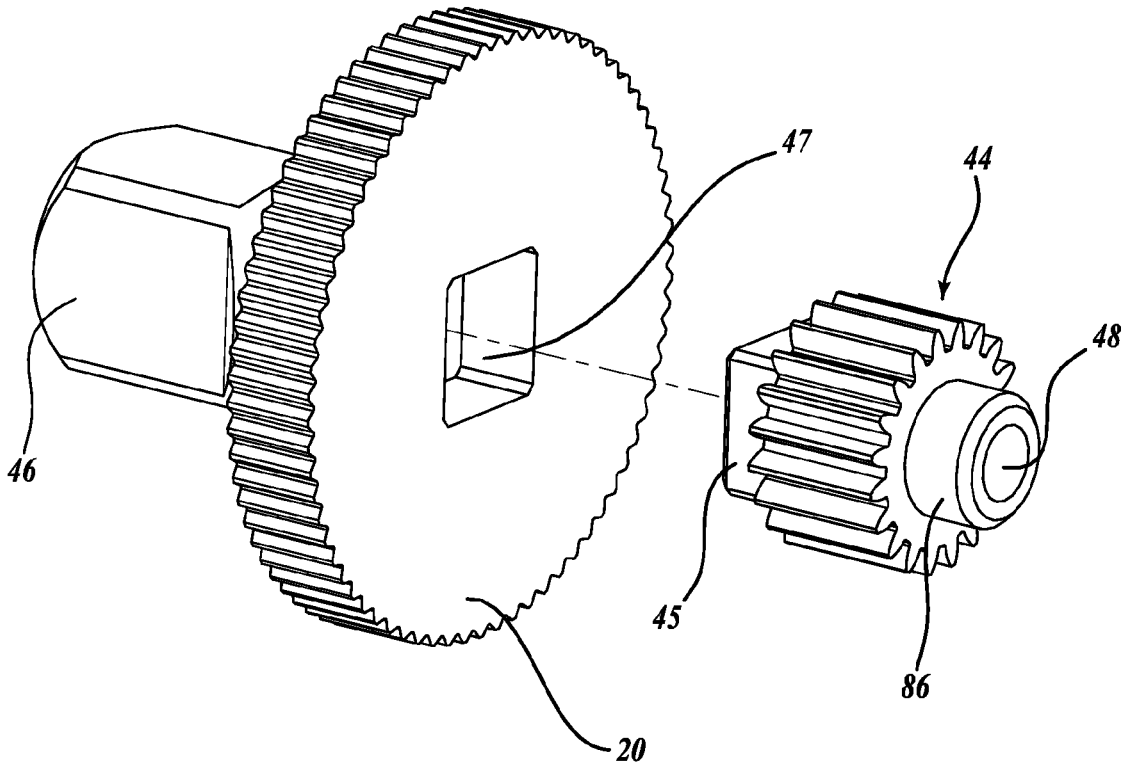
FIG. 3 is a rear isometric view of the output gear and sun gear of the ratchet device of FIG. 1.

Now referring to FIG. 3, the sun gear 44 is coupled to the inside surface of the output gear 20 by mating a non-cylindrical boss 45 formed on one side of the sun gear 44 with a corresponding non-cylindrical recess 47 formed on the inside surface of the output gear 20. It is preferred, but not essential, that a square boss 45 and square recess 47 be used. Mating the sun gear 44 to the output gear 20 in this manner ensures that the two components will rotate in a 1:1 relation to one another when a torque is applied to the sun gear 44. It can be appreciated that other means for fastening the sun gear 44 to the output gear 20 may also be used. For instance, a fastener, such as a screw, may be used to mate the sun gear 44 to the output gear 20 in lieu of the boss 45 and recess 47. Moreover, the sun gear 44 and output gear 20 may be formed as one piece.

As shown in FIGS. 2 and 3, an output shaft 46 is coupled to the outside surface of the output gear 20 to collectively define an output member. The output shaft 46 is polygonally shaped in cross-section, preferably in the shape of a square. A ratchet socket (not shown) may be mated with the output shaft 46 for engaging a fastener. The output shaft 46 may be formed with the output gear 20 as one piece, but may alternatively be formed separately from the output gear 20 and thereafter mated together.

Referring back to FIG. 2, the output gear 20 is suitably sized to be received within counterbore 29. Referring to FIGS. 2 and 3, the output gear 20 and sun gear 44 are retained within the ratchet head 16 by coupling the sun gear 44 to the pommel 30. A cylindrical boss 86 formed on the second side of the sun gear 44 is received within a counterbore 88 formed in the raised circular portion 32 of the pommel 30. The output gear 20 and sun gear 44 may be further secured to the raised circular portion 32 of the pommel 30 with a fastener, such as a screw, pin, etc. To facilitate the fastening, a threaded opening 48 is formed in the output gear 20, sun gear 44 and cylindrical boss 86 along the center axis of each. Moreover, a non-threaded cylindrical through-hole 90 is formed in the pommel 30 and extends from the counterbore 88 to a counterbore 92 formed on the outside surface of the pommel 30. Thus, the fastener passes through the pommel 30, sun gear 44, and output gear 20 to couple the three pieces together. The threaded opening 48 may also be formed in the output shaft 46 such that the fastener passes through the pommel 30, sun gear 44, output gear 20, and output shaft 46 in the same fashion.

The cylindrical boss 86 is smaller in diameter than the counterbore 88. Moreover, the cylindrical through-hole 90 is non-threaded so that a screw or other threaded fastener may rotate freely within the cylindrical through-hole 90. Thus, the cylindrical boss 86 is rotatably received within the counterbore 88 thereby allowing the output gear 20 and sun gear 44 to rotate freely about their center axes when secured to the pommel 30.

Figure 4:
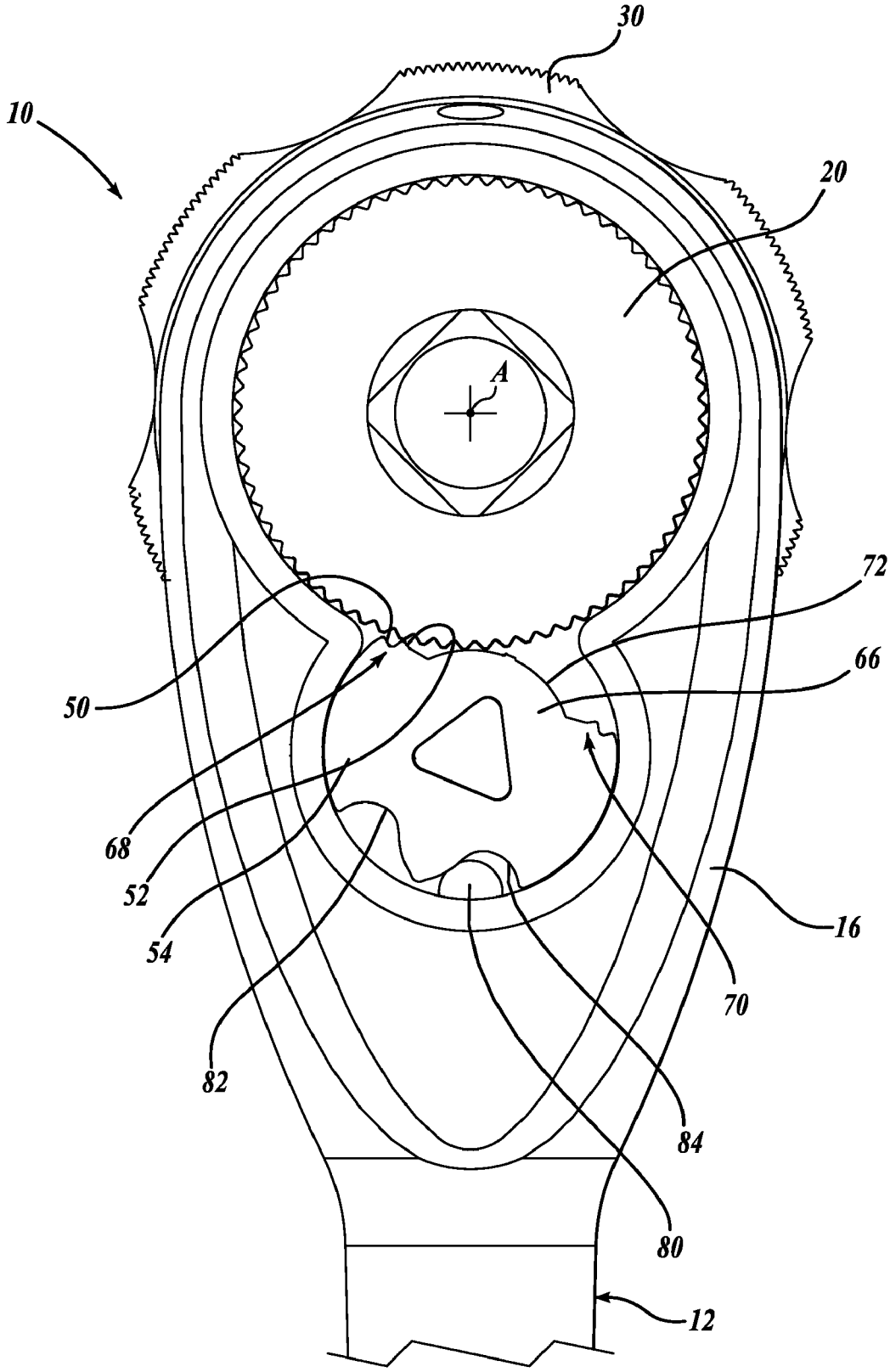
FIG. 4 is a front view of a ratchet device with the switch member in the second position.

Referring to FIGS. 1 and 4, the ratchet device 10 includes a switch member 22 coupled to the front side of the ratchet head 16. The switch member 22 includes a substantially circular switch plate 54 with a central triangular opening 56. The circular switch plate 54 is received within a circular recess 58 formed within the ratchet head 16, wherein the circular recess 58 intersects the second counterbore 29. The central triangular opening 56 aligns a circular through-hole 62 formed in the ratchet head 16, and a portion of a toggle member 60 passes through the through-hole 62 and into the central opening 56 of the switch plate 54. The toggle member 60 includes a triangular shaft 61 that is rotatably received within the through-hole 62 and is fixedly received within the central triangular opening 56 of the switch plate 54. It should be appreciated that the central opening 56 and the shaft 61 may be any suitable polygonal shape. The toggle member 60 further includes a circular end 63 that is slightly smaller in diameter than the through-hole 62. The circular end 63 is rotatably received within the circular through-hole 62.

A lever 64 is coupled to the circular end 63 of the toggle member 60, and is used to torque the toggle member 60 about its center longitudinal axis. The lever 64 is orthogonal to the toggle member 60, and has a shape such that a user may easily grip the lever 64 to toggle the toggle member 60 between first and second positions. The bottom surface of the lever 64 abuts the ratchet head 16 when the toggle member 60 is inserted into the circular through-hole 62 and slides smoothly against the surface of the ratchet head 16. When the triangular portion 61 is torqued by the lever 64 about its longitudinal center axis, the triangular portion 61 engages the switch plate 54 through the central opening 56 and rotates the switch plate 54 about its center axis into a first or second position.

The circular switch plate 54 has an upper locking edge 66. The upper locking edge 66 includes first and second teeth sections 68 and 70. Disposed between the first and second teeth sections 68 and 70 on the upper locking edge 66 is a curved portion 72. Referring to FIG. 4, when the switch member 22 is toggled between first and second positions, the first and second teeth sections 68 and 70 are displaced upwardly against the output gear 20. The first teeth section 68 is displaced upwardly when the switch member 22 is toggled into the second position, and the second teeth section 70 is displaced upwardly when the switch member 22 is toggled into the first position.

The first and second teeth sections 68 and 70 include a contoured tooth portion 52 and a straight tooth portion 50. When the switch member 22 is toggled into the second position, and the output gear 20 is rotating in the clockwise direction, the output gear 20 engages the contoured tooth portion 52 of the first tooth section 68, and follows the path established by the contoured surface, displacing the switch member 22 in a downward counterclockwise direction. The straight tooth portion 50 does not engage the output gear 20. With the first teeth section 68 out of substantial contact with the output gear 20, the output gear 20 may continue rotating clockwise. When the switch member 22 is in the first position (not shown) and the output gear 20 is rotating counterclockwise, the output gear 20 engages the contoured tooth portion 52 of the second teeth section 70 and urges the switch member 22 downward, rotating the switch member 22 slightly clockwise. With the second teeth section 70 out of full contact with the output gear 20, the output gear 20 continues rotating counterclockwise.

When the straight tooth portion 50 engages the output gear 20, the output gear 20 is prevented from rotating in either the clockwise or counterclockwise direction (depending on the position of the switch member 22). If the output gear 20 is rotating counterclockwise and the switch member 22 is in the second position, as depicted in FIG. 4, the straight tooth portion 50 of the first teeth section 68 engages the output gear 20 and prevents the gear 20 from further rotating counterclockwise. If the output gear 20 is rotating clockwise and the switch member 22 is in the first position, the straight tooth portion 50 of the second teeth section 70 engages the output gear 20 and prevents the gear 20 from further rotating clockwise.

Referring to FIGS. 2 and 4, the switch member 22 is retained within the first or second position with a ball detent mechanism. The circular recess 58 includes a transverse cylindrical bore 76 that receives a coil spring (not shown). The coil spring engages a ball 80 and urges the ball 80 within a first or second recess 82 or 84 formed on the switch plate 54. The switch plate 54 may be rotated between the first position, where the ball 80 is urged into the first recess 82, and the second position, where the ball 80 is urged into the second recess 84.

The first and second recesses 82 and 84 have contoured surfaces. The ball 80 follows a path established by the contoured surfaces 82 and 84 and is moved in and out of the first and second recesses 82 and 84 when the switch plate 54 rotates. The non-recessed portion disposed between the circular recesses 82 and 84 depresses the ball 80 against the spring and into the cylindrical bore 76 when the switch plate 54 rotates. In this manner, the ball 80 is moved from the first recess 82, into the cylindrical bore 76, and then into the second recess 84, and vice versa. Thus, the contoured recesses 82 and 84 and the non-recessed portion therebetween act as bearing surfaces for the ball 80. To provide a "snap-action" tactile characteristic, the contoured bearing surfaces of the recesses 82 and 84 decrease in steepness or ramp angle near the non-recessed portion so that the force required to displace the ball 80 into the recesses 82 and 84 decreases as the switch plate 54 is moved into the first or second position.

The switch plate 54 is rotated between the first and second positions when the lever 64 is toggled from left to right. The lever 64 is shifted to the right to rotate the switch plate 54 counterclockwise and displace the ball 80 into the first recess 82 and into the first position. When the ball 80 moves into the first recess 82, the switch plate 54 snaps into the first position and temporarily locks the lever 64 in the first position. The lever 64 is shifted to the left to rotate the switch plate 54 clockwise and displace the ball 80 into the second recess 84 and into the second position. When the ball 80 moves into the second recess 84, the switch plate 54 snaps into the second position and temporarily locks the lever 64 in the second position. Thus, a "snap-action" tactile characteristic enables the user to determine whether the switch member 22 is fully engaged in the first or second position.

The ratchet device 10 is used to tighten or loosen a fastener while torquing the handle 12 in both the clockwise and counterclockwise direction. A ratchet socket (not shown) is first coupled to the output shaft 46 for engaging a fastener. Any standard ratchet socket commonly known in the art may be used for driving or removing the fastener. With the ratchet socket engaging a fastener, the handle 12 is torqued in either the clockwise or counterclockwise direction to drive or loosen the fastener.

Figure 5:
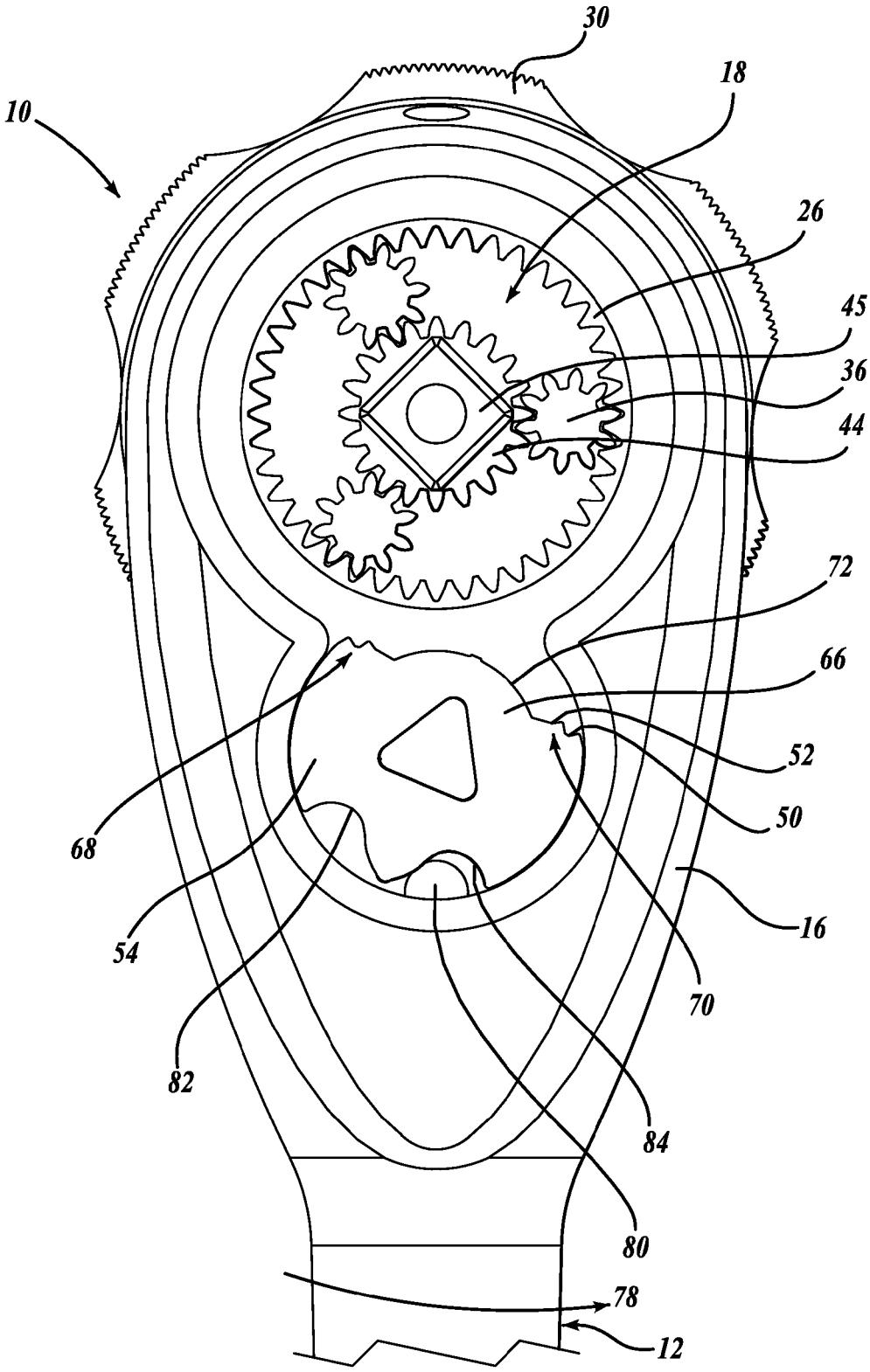
FIG. 5 is a front view of a ratchet device of FIG. 4 with the switch member in the second position, wherein the output gear has been removed for clarity.

Referring to FIG. 5, if the user desires to drive the fastener in a clockwise direction, the lever 64 is used to displace the switch member 22 in the second position so that the ball 80 is urged into the second recess 84. With the pommel 30 held in a stationary position, the handle 12 is torqued counterclockwise about axis A, which extends normal to the major axis of the ratchet head 16 and passes through the center of the receiving hole 24. When the handle 12 is torqued counterclockwise, as depicted by arrow 78, the ring gear 26 rotates with the ratchet head 16 in a counterclockwise direction. The ring gear 26 drives the planetary gears 36 to rotate in a counterclockwise direction. The planetary gears 36 then cause the sun gear 44 to rotate in a clockwise direction. Since the output gear 20 and output shaft 46 are directly coupled to the sun gear 44, the output gear 20 and output shaft 46 also rotate in a clockwise direction. The output gear 20 engages only the contoured tooth portion 52 of the first teeth section 68 when the switch member 22 is in the second position, so the output gear 20 continues to rotate clockwise. Thus, when the switch member 22 is in the second position, the pommel 30 is held stationary, and the handle 12 is torqued counterclockwise, the output gear 20 is freely rotatable in the clockwise direction. Accordingly, the output shaft 46 is torqued clockwise and therefore drives the fastener in the clockwise direction.

Now referring to FIG. 4, the fastener is driven in the clockwise direction when the handle 12 is torqued clockwise during the return stroke. When the handle 12 is torqued clockwise, the gear assembly 18 urges the output gear 20 to rotate counterclockwise. However, with the switch member 22 in the second position, the straight tooth portion 50 of the first teeth section 68 engages the output gear 20 and prevents the output gear 20 from further rotating counterclockwise. The output gear 20 and output shaft 46, as well as the rest of the gear assembly 18 and the pommel 30, therefore rotate clockwise with the ratchet head 16 and handle 12 as one unit. Thus, the output shaft 46 continues to drive the fastener in a substantially clockwise direction during the return stroke.

As shown in both FIGS. 4 and 5, the output shaft 46 effectively moves in a substantially clockwise direction when the handle 12 is torqued in both the counterclockwise and clockwise directions if the switch member 22 is in the second position. Thus, the output shaft 46 may be used to drive the fastener while operating the handle 12 in both directions.

If the user desires to loosen the fastener by torquing the fastener in a counterclockwise direction, the lever 64 is used to displace the switch member 22 into the first position. With the pommel 30 held in a substantially stationary position, the handle 12 is torqued about the center axis of the receiving hole 24 to actuate the gear assembly 18. When the handle 12 is torqued in the clockwise direction, the ring gear 26 and planetary gears 36 rotate in a clockwise direction. As a result, the sun gear 44 rotates in a counterclockwise direction. Since the output gear 20 and output shaft 46 are directly coupled to the sun gear 44, the output gear 20 and output shaft 46 also rotate in a counterclockwise direction. Moreover, since the output gear 20 engages only the contoured tooth portion 52 of the second teeth section 70, the output gear 20 continues to rotate counterclockwise. Thus, when the switch member 22 is in a first position, the pommel 30 is held stationary, and the handle 12 is torqued clockwise, the output gear 20 is freely rotatable in the counterclockwise direction. Accordingly, the output shaft 46 loosens the fastener by torquing it counterclockwise.

The fastener may also be loosened during the return stroke when the handle 12 is torqued counterclockwise with the switch member 22 in the first position. When the handle 12 is torqued counterclockwise, the output gear 20 is urged to rotate in the clockwise direction. However, when the output gear 20 begins to rotate clockwise, the straight tooth portion 50 of the second teeth section 70 engages the output gear 20 and prevents the gear 20 from further rotating clockwise. The output gear 20 and output shaft 46, as well as the rest of the gear assembly 18 and the pommel 30, therefore rotate counterclockwise with the ratchet head 16 and handle 12 as one unit. Thus, the output shaft 46 continues to loosen the fastener by torquing the fastener in a substantially counterclockwise direction.

While illustrative embodiments have been illustrated and described, it will be appreciated that various changes can be made therein without departing from the spirit and scope of the present disclosure.

The invention claimed is:

1. A ratchet device, comprising:

(a) a ratchet body having a handle and a ratchet head fixedly mounted to the handle such that no portion of the ratchet head is capable of being moved independent of the handle, the handle being reciprocally rotatable in first and second handle directions about an axis extending substantially normal to a major axis of the ratchet head, the ratchet head including a receiving hole;

(b) a ring gear fixedly secured within the receiving hole such that the ring gear is not moveable independent of the ratchet head;

(c) a planetary gear assembly disposed within the ratchet head, the planetary gear assembly having a sun gear and at least one planet gear in drivable engagement with the ring gear and the sun gear;

(d) an output gear coupled to the sun gear such that the output gear is rotatable with the sun gear, wherein the output gear is rotatable in a substantially constant output gear direction when the handle is reciprocated between first and second handle directions; and (e) a switch coupled to the ratchet head and engageable with the output gear, wherein the switch may be toggled between first and second switch positions to enable the output gear to rotate in a first or second substantially constant output gear direction when the handle is reciprocated between first and second handle directions; and (f) a gripping member rotatably disposed externally on the ratchet head, wherein the sun gear and the at least one planet gear are rotatably mounted within the gripping member, wherein the gripping member remains substantially stationary when the handle rotates in the first handle direction, and wherein the gripping member moves with the handle when the handle rotates in the second handle direction.

2. The ratchet device of claim 1, wherein the gripping member defines a circular edge having formations thereon to define a gripping surface of the gripping member.

3. The ratchet device of claim 1, wherein the output gear rotates in a direction opposite the handle when the handle rotates in the first handle direction, and wherein the output gear rotates with the handle when the handle rotates in the second handle direction.

4. The ratchet device of claim 1, wherein the switch member is toggled between the first switch position to substantially prevent rotation of the output gear in the first output gear direction, and a second switch position to substantially prevent rotation of the output gear in the second output gear direction.

5. The ratchet device of claim 4, wherein the switch member is toggled between the first switch position to allow rotation of the output gear in the second output gear direction, and the second switch position to allow rotation of the output gear in the first output gear direction.

* * * * *